United States Patent [19]

Mills et al.

[11] Patent Number: 4,520,117

[45] Date of Patent: May 28, 1985

[54] REFRACTORY ARTICLES AND THE METHOD FOR THE MANUFACTURE THEREOF

[75] Inventors: David Mills; Alan D. Kington; Philip J. Lovell, all of Bristol, England

[73] Assignee: Rolls-Royce Limited, England

[21] Appl. No.: 360,952

[22] Filed: Mar. 23, 1982

[30] Foreign Application Priority Data

Apr. 9, 1981 [GB] United Kingdom ..... 8111223

[51] Int. Cl.[3] ..... C04B 39/08

[52] U.S. Cl. ..... 501/107; 264/58; 264/60; 264/63; 264/325; 264/328.1; 264/332; 501/127

[58] Field of Search ..... 264/62, 328.1, 63, 58, 264/60, 325, 332; 501/107, 127

[56] References Cited

U.S. PATENT DOCUMENTS

| | | | |
|---|---|---|---|
| 2,291,788 | 8/1942 | Bean | 249/110 |
| 2,968,083 | 1/1961 | Lentz | 264/62 |
| 3,554,830 | 1/1971 | Riley | 264/58 |
| 3,999,004 | 12/1976 | Chirino | 264/62 |
| 4,046,612 | 9/1977 | Warner | 264/60 |
| 4,133,371 | 9/1979 | Birch et al. | 164/350 |
| 4,172,107 | 10/1979 | Nakamura | 264/60 |
| 4,215,088 | 7/1980 | Ardary | 264/60 |
| 4,289,719 | 9/1981 | McIntosh | 264/332 |

FOREIGN PATENT DOCUMENTS

| | | |
|---|---|---|
| 2832377 | 8/1979 | Australia . |
| 506574 | 10/1980 | Australia . |
| 1097885 | 3/1981 | Canada . |
| 567179 | 12/1932 | Fed. Rep. of Germany . |
| 1932971 | 7/1971 | Fed. Rep. of Germany . |
| 1583554 | 11/1971 | Fed. Rep. of Germany . |
| 2518155 | 4/1976 | Fed. Rep. of Germany . |
| 858231 | 12/1977 | France . |
| 2363388 | 3/1978 | France . |
| 53-30420 | 3/1978 | Japan . |
| 7709449 | 2/1978 | Netherlands . |
| 7709729 | 1/1978 | Sweden . |
| 1584367 | 2/1981 | United Kingdom . |

*Primary Examiner*—John A. Parrish

*Attorney, Agent, or Firm*—Parkhurst & Oliff

[57] ABSTRACT

In a process for making refractory articles, such as cores and moulds for use in casting metals, the articles are formed from dies using a refractory material mixed with a thermosetting resin. The articles are formed with the mixture heated to a softened state and the resin is cured. Thereafter the article has to be fired and problems have arisen with deformation of the articles during the firing process.

With the present invention, the articles, 8, which as can be seen in FIG. 2 are mould segments, are bound into an assembly with a flexible refractory tape (15) which shrinks on firing to a greater extent than the articles, and thus pulls the assembly tightly together whereby each article provides support for the adjacent article and prevents distortion. The joint faces between the mould segments are thus held in tight abutment and for pouring metal into the mould, the firing cup is fitted and a coating of refractory slurry is brushed on without removing the tape to seal the assembly.

The process is also applicable to the manufacture of cores to prevent bending during firing.

37 Claims, 4 Drawing Figures

REFRACTORY ARTICLES AND THE METHOD FOR THE MANUFACTURE THEREOF

Figure 1:
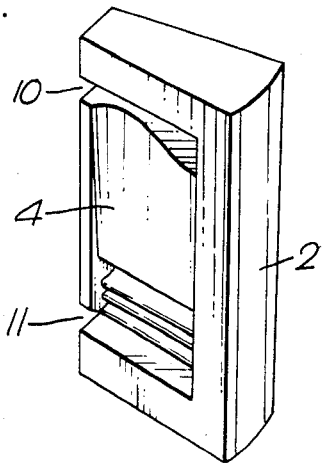

The present invention relates to a method of producing refractory articles, and to refractory articles produced by the method. The invention relates in particular, but not exclusively, to the production of refractory molds and cores for the casting of metals.

In U.K. Pat. No. 1,584,367 there is disclosed a method of making a mold assembly for casting metal articles, and in which the mold assembly consists of a plurality of mold segments each of which has a part of a mold cavity shaped in a side-face thereof, and which are fitted together to form a complete mold assembly for casting a plurality of articles simultaneously. In one example of the method disclosed in that patent the mold segments are wedge-shaped and are fitted together to make a cylindrical mold assembly, and the mold segments are produced by injection of the mold material into a die in the so-called green state and subsequently firing them to produce a high temperature mold material.

One of the problems encountered with the use of the above-described method is that of distortion of the green mold segments during firing. Since the mold segments have to fit closely together during pouring of the metal to avoid metal leakage from each individual mold cavity, the abutting faces of each pair of mold segments have to be a good fit together. Any distortion of the green mold during firing which prevents the abutting faces fitting flush together can cause scrapping of the mold segments. In the past significant trouble has had to be taken to ensure accurate fitting of the fired molds. One method used is to design the two mold halves so that at least one of the abutting faces is flat, and to fire the mold with its flat face on a flat surface in the firing oven. This method has not only meant that relatively few molds could be fired at any one time but has put a restriction on the design of the mold.

Another problem encountered has been that of keeping the mold segments tightly held together during the pouring of the metal when the molds are pre-heated to temperature of 1000° C. or more. Clearly metal clamps are ineffective at these temperatures because the differential thermal expansion between the metal and the molds releases the clamping load. In the method described in U.K. Pat. No. 1,584,367 referred to above, flanged ceramic covers are placed over the ends of the mold assembly which act to hole the mold segments in place. However, these covers have to be accurately made in order to fit closely enough around the mold assembly which makes them expensive to produce.

An object of the present invention is to overcome these problems.

We have found that the solution to the above-described problems is also capable of providing benefits in controlling the accuracy of other refractory parts during manufacture, for example, cores for casting, so that the invention is capable of much wider application than the manufacture of mold assemblies.

According to the present invention a method of making refractory articles comprises the steps of:

making a die for each article, using the die to form the article using a refractory material mixture and curing the material into its green state;

removing the green article from the die;

assembling a plurality of the green articles in a closely-packed array;

binding the array of articles tightly together with one or more bands of flexible high temperature material which shrinks on heating to a greater extent than the green refractory material, and firing the bound assembly of articles.

By this means, each article in the array provides support for the adjacent article and distortion is substantially prevented during the firing operation.

The best results are obtained when the refractory material mixture from which the articles are to be made contains both a thermo-setting resin binder, which does not soften again after curing, and a sufficient quantity of a plasticiser material to allow some give in the assembly during firing.

The articles may be assembled into any conveniently-shaped array, for example, cylindrical or rectangular, but it has been found that, very good results are obtained if the articles are wedge-shape segments and are assembled into a cylindrical array.

The term article in this specification is intended to include both the required article to be made, and any filler pieces which are used to make up the assembled array.

For example, where the required article is an aerofoil-shaped core for use in casting a hollow gas turbine engine blade the assembled array may be in the form of a hollow cylinder made up alternately of aerofoil-shaped cores and filler pieces with side-faces of a complementary shape for abutting the flanks of the cores.

In another embodiment of the invention mold segments are made which are suitable for use in casting metal articles by the multiple casting method described in U.K. Pat. No. 1,584,367 or modifications of that method.

The formation of the material in its green form using the die, is preferably carried out in an injection molding machine, as known per se, but any other forming technique may be used, for example, hot pressing, or vacuum forming.

Figure 2:
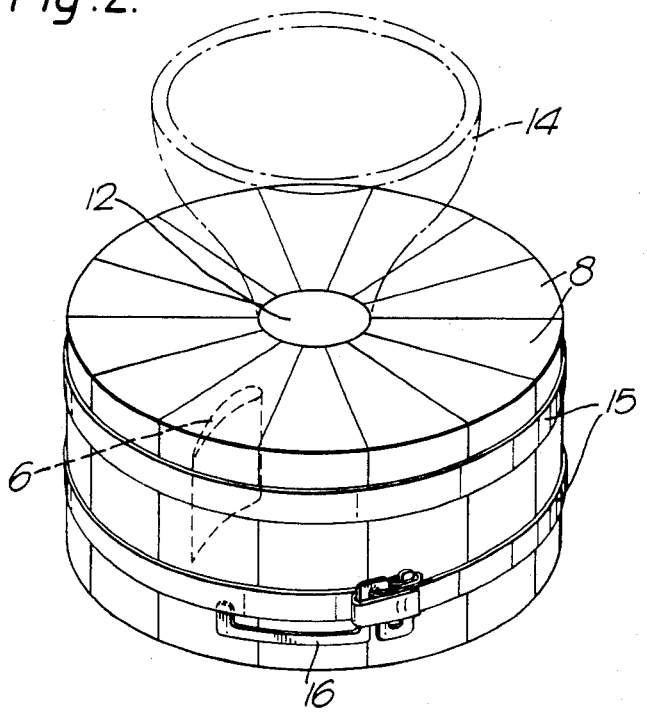
Figure 3:
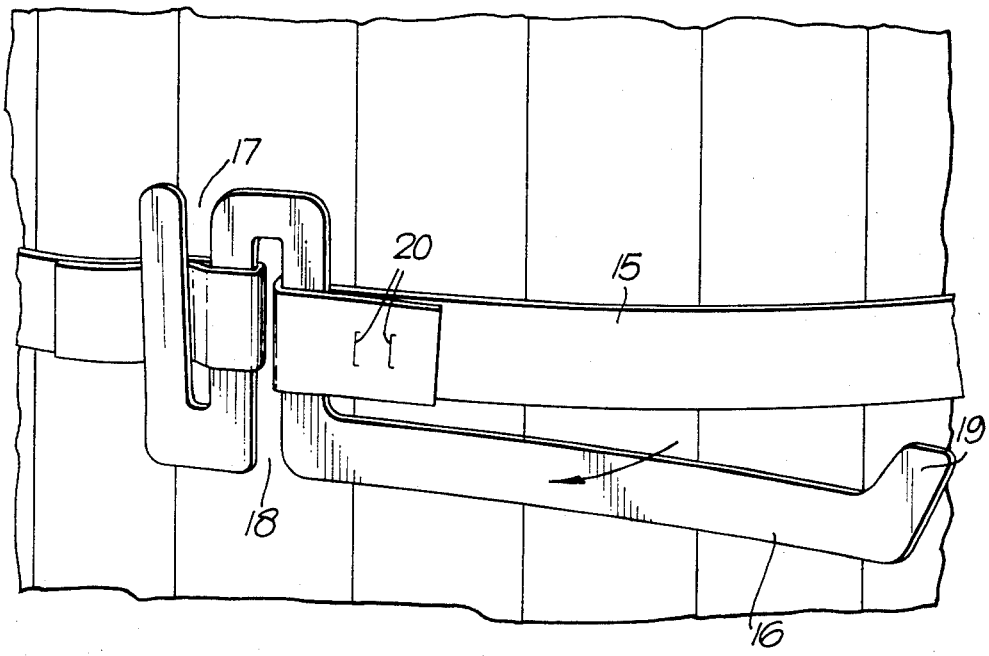
Figure 4:
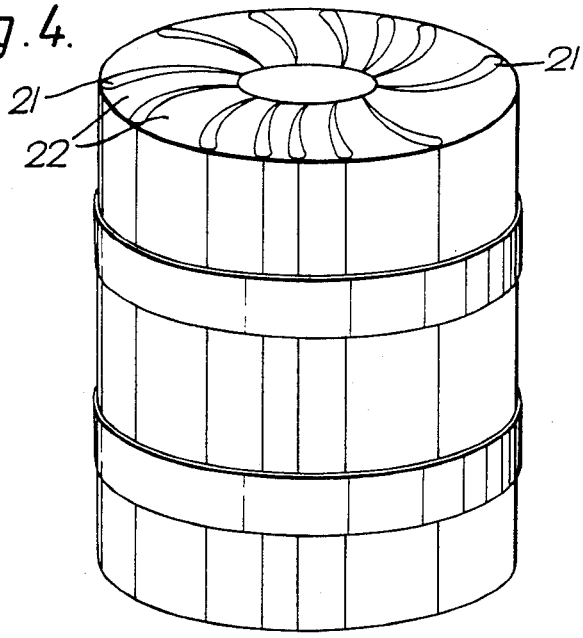

The invention will now be described in more detail, merely by way of example, with reference to the accompanying drawings in which:

FIG. 1 is an illustration of a segment of a refractory mold made in accordance with the invention, FIG. 2 is an illustration of an assembly of the mold segments of FIG. 1 in a cylindrical array, FIG. 3 is an enlarged view of a mechanical lock arrangement for tensioning the band of refractory material holding the mold assembly together, and, FIG. 4 is an illustration of an assembly of cores and filler pieces in a cylindrical array prior to firing.

Referring now to the drawings there is shown in FIGS. 1 and 2 a segment 2 of a mold for casting blades for gas turbine engines. The segment 2 has formed in one, or in this case both faces thereof, a part 4 of a cavity 6 which in the complete mold 8 forms the shape of the blade to be cast. At each end of the cavity is provided a recess 10,11 extending completely through the segment 2 so that when the segment is positioned abutting adjacent segments on each side, complete annular spaces are provided with which all of the cavities of the molds in the array communicate. Each of the segments 2 are wedge-shaped and are truncated so that when they are assembled into an array of molds (see FIG. 2) a central pouring aperture 12 is produced which communicates with both spaces. By this means metal poured into the pouring cup 14 passes down the central aperture 12 to the bottom space from which all of the mold cavities are simultaneously filled.

The mold segments are made by injection of ceramic material into suitably shaped dies. The injection is carried out hot so that by the time it has cooled, the material is cured into its green state and is capable of being handled without significant deformation. The actual materials used may be conventional core-making materials, or variations thereof, and are based on standard refractories, e.g. Silica, Alumina and Zircon together with a silicone or Phenol Formaldehyde thermosetting resin binder. Examples of suitable compositions are given below:

EXAMPLE I

| | | |
|---|---|---|
| Alumina - 200 mesh | 700 grams | Standard Aluminium Oxide Powder |
| Phenol Formaldehyde | 110 grams | Bordens Powdered Shell Resin TFSX-4, a powdered phenolic novalac/hexamine |
| Aluminium Stearate | 6 grams | Release agent and plasticiser |
| Toluene | 15 milliliters | |

This composition is mixed at 110° C., the Toluene being added to lower the melting point of the mixture whereby it softens at a lower temperature and more efficient mixing can be effected before any significant curing of the resin takes place.

EXAMPLE II

| | | |
|---|---|---|
| Zircon - 200 mesh | 800 grams | Standard Zirconium Silicate Powder |
| Silicone Resin | 110 grams | Type R62230 supplied by Dow Corning Ltd. |
| Aluminium Stearate | 6 grams | Release agent and plasticiser |
| Aluminium Acetate | 3 grams | |
| Toluene | 10 milliliters | |

This composition is mixed at 90° C.

The resins used are thermo-setting resins to give dimensional stability to the molds during the remainder of the process. The plasticiser is added to ensure that the molds do not become so rigid, once set, that no flexibility is available during the firing process, and may be omitted if the molds in their green state have sufficient flexibility.

Although injection molding of the segments has been described above it is envisaged that some articles may initially be made in their green state from dies by other means, such as pressing or vacuum forming.

The molds as exemplified in FIGS. 1 and 2 are wedge-shaped so that when a sufficient number are assembled together they form a cylindrical assembly as seen in FIG. 2. In order that they should have the requisite strength for metal casting the green molds must be fired at a high temperature which depends on the material of the mold.

The materials disclosed in the above Examples I and II and which are capable of withstanding the casting of high temperature materials for use in turbine blades, are fired in two stages. The first stage is a low temperature stage during which the resin binder is burned away, while the second stages causes sintering of the ceramic at around 1100° C.

In order to hold the assembly together during firing the assembly is tightly bound at the top and bottom with a flexible tape 15 which is capable of withstanding the required temperature. A suitable tape is made from a refractory material sold under the trade name REFRASIL by the Chemical and Insulating Co. Ltd. of Darlington, England, and in particular the material REFRASIL C1400 has been found to be suitable.

However, not only does this material have the capability of holding the assembly together at high temperatures, but it has been found to shrink at a greater rate than the ceramic material of the mold assembly during firing. This makes possible a very advantageous change in the method of making the molds. Whereas in the past, the mold segments were individually fired on flat plates in order to minimise distortion during firing, which meant that relatively few mold segments could be fired at once, now the complete mold assembly bound by the shrinking tape can be fired. Not only does this increase the number of mold segments which can be fired at any one time but, as the molds shrink, the tape, which shrinks faster, pulls the wedge-shaped mold segments towards the axis of the cylinder pressing the side-faces together thus closing any gaps between the surfaces and preventing distortion. In fact, if any of the mold segments are distorted before firing, they are likely to be straightened as they are compressed towards the cylinder axis. As a result the cost of the process is reduced and greater accuracy is obtained in the finished castings.

In order that the tape should contact as far as possible the complete circumference of the mold assembly, and that the tape can be pulled tightly around the circumference, a mechanical lock is introduced to join the ends of the tape. The lock is shown in FIG. 3 in its untensioned state.

The mechanical lock consists simply of a curved high temperature metal buckle made from a material sold under the trade name NIMONIC and having an arm 16 with two loops 17 and 18 at one end for receiving the ends of the tape, and a lug 19 at the other end. One end of the tape is passed through the loop 18, folded back on itself and stapled to the body of the tape with high temperature metal staples 20. The other end of the tape is passed through loop 18, folded back through loop 17 and its length is adjusted so that when the arm is moved through 180° to lie around the outside of the assembly, as shown in FIG. 2, the second end of the tape is pulled over the first end and trapped to tension the tape, and the lug 19 is tucked under the tape to hold the lock in position.

All that remains to be done to the fired mold assembly prior to casting, therefore, is to fit the pouring cup and seal the joint edges with a ceramic slurry to prevent any possible escape of liquid metal from the mold assembly.

Although the mold assembly has been shown herein as cylindrical and the mold segments wedge-shaped, in principle the benefits of the invention can be obtained with rectangular, or other shaped mold assemblies.

A further advantage of the method described above is that it is no longer necessary for either of the mold segments to have a flat face, and this gives greater freedom of design to the mold cavity.

FIG. 4 shows how the present invention can be applied to the manufacture of cores, particularly to long thin cores which can bend during the firing process if not properly supported.

The cores 21 and complementary filler pieces 22 are made in appropriately shaped dies by injection molding, as described above, or in any other suitable manner, and cured into their green state. They are then packed together into an assembly as shown in the Figure and bound with REFRASIL tape. As described above, during the firing process the cores and filler pieces give mutual support to each other and prevent any bending or distortion. After firing the filler pieces are discarded. A great advantage of this method of making cores is that the cores and their supports, i.e. the filler pieces all shrink together so that neither adversely affects the other.

In a further extension of the invention it is envisaged that, by packing appropriately shaped mold segments, core pieces and filler pieces together in their green state and binding them with the REFRASIL tape before firing, it will not only be possible to make both cores and molds to a greater accuracy than has been possible hitherto, but also to ensure that the cores will be accurately positioned in the molds.

We claim:

1. A method for producing a refractory article comprising:

filling at least one die with a refractory material consisting essentially of a refractory material selected from the group consisting of silica, alumina zircon and zirconium silicate;

forming a plurality of pre-forms having a shape corresponding to said at least one die;

curing the refractory material mixture pre-forms into their green state;

removing the green pre-forms from said at least one die;

assembling a plurality of the green pre-forms loosely in a closely-packed array resulting in contacting engagement between peripheral surfaces of adjacently located green pre-forms;

circumferentially clamping the array of pre-forms tightly together with one or more bands of flexible high temperature material, which shrinks on heating to a greater extent than the green refractory pre-forms, such that the pre-forms are provided with at least a limited degree of relative movement during firing to accomodate deformations in the pre-forms during firing;

firing the circumferentially clamped assembly of pre-forms such that the peripheral surfaces of adjacently located pre-forms achieve substantial contact therebetween and remain in substantial contact due only to peripheral confining pressure upon the assembly of pre-forms, without any sintering occurring between individual pre-forms, resulting from the relative greater shrinkage of the high temperature material.

2. The method of producing refractory articles of claim 1, wherein the flexible high temperature material comprises a woven tape of refractory material.

3. The method of producing refractory articles of claim 1, wherein the article comprises a plurality of cores for use in metal castings.

4. The method of producing refractory articles of claim 1, wherein the article comprises a mold for use in metal castings.

5. The method of producing refractory articles of claim 1, wherein the refractory material mixture comprises, a refractory powder, in a thermosetting silicone or phenolic resin binder.

6. The method of producing refractory articles of claim 5, wherein the formation of the article in the die includes the further steps of heating the mixture to a temperature at which it softens but below the setting temperature of the resin binder, and injecting the hot material into the die under pressure.

7. The method of producing refractory articles of claim 1, wherein the flexible high temperature material is tensioned during the circumferentially clamping step and the tension in the high temperature material is prevented from relaxing by using mechanical lock means.

8. A refractory article made by the method of claim 1.

9. A refractory article made by the method of claim 2.

10. A refractory article made by the method of claim 3.

11. A refractory article made by the method of claim 4.

12. A refractory article made by the method of claim 5.

13. A refractory article made by the method of claim 6.

14. A refractory article made by the method of claim 7.

15. A method for producing a refractory article comprising:

filling at least one die with a refractory material consisting essentially of a refractory material selected from the group consisting of silica, alumina zircon and zirconium silicate;

forming a plurality of pre-forms having a shape corresponding to said at least one die;

curing the refractory material mixture pre-forms into their green state;

removing the green pre-forms from said at least one die;

assembling a plurality of the green pre-forms loosely in a closely-packed array resulting in contacting engagement between peripheral surfaces of adjacently located green pre-forms;

circumferentially clamping the array of pre-forms tightly together with one or more bands of flexible high temperature material, which shrinks on heating to a greater extent than the green refractory pre-forms, such that the pre-forms are provided with at least a limited degree of relative movement during firing to accomodate deformations in the pre-forms during firing;

firing the circumferentially clamped assembly of pre-forms such that the peripheral surfaces of adjacently located pre-forms achieve substantial contact therebetween and remain in substantial contact due to peripheral confining pressure upon the assembly of pre-forms, without any sintering occurring between individual pre-forms resulting from the relative greater shrinkage of the high temperature material.

16. The method of producing refractory articles of claim 15, wherein the flexible high temperature material comprises a woven tape of refractory material.

17. The method of producing refractory articles of claim 15, wherein the article comprises a plurality of cores for use in metal castings.

18. The method of producing refractory articles of claim 15, wherein the refractory article comprises a mold for use in metal castings.

19. The method of producing refractory articles of claim 15, wherein the refractory material comprises a refractory powder in a thermosetting silicone or phenolic resin binder.

20. The method of producing refractory articles of claim 19, wherein the formation of the article in the die includes the further steps of heating the mixture to a temperature at which it softens, but below the setting temperature of the resin binder, and injecting the hot material into said at least one dye under pressure.

21. The method of producing refractory articles of claim 15, wherein the flexible high temperature material is tensioned during the circumferentially clamping step and the tension in the high temperature material is prevented from relaxing by using a mechanical lock means.

22. A refractory article made by the method of claim 15.

23. A refractory article made by the method of claim 16.

24. A refractory article made by the method of claim 17.

25. A refractory article made by the method of claim 18.

26. A refractory article made by the method of claim 19.

27. A refractory article made by the method of claim 20.

28. A refractory article made by the method of claim 21.

29. A method of casting an article comprising:

filling at least one die with a refractory material consisting essentially of a refractory material selected from the group consisting of silica, alumina zircon and zirconium silicate;

forming a plurality of pre-forms having a shape corresponding to said at least one die;

curing the refractory material mixture pre-forms into their green state;

removing the green pre-forms from said at least one die;

assembling a plurality of the green pre-forms loosely in a closely-packed array, thereby forming cavities between said plurality of green pre-forms through the contacting engagement between peripheral surfaces of adjacently located green pre-forms;

circumferentially clamping the array of pre-forms tightly together with one or more bands of flexible high temperature material, which shrinks on heating to a greater extent than the green refractory pre-forms, such that the pre-forms are provided with at least a limited degree of relative movement during firing to accomodate deformations in the pre-forms during firing;

firing the circumferentially clamped assembly of pre-forms such that the peripheral surfaces of adjacently located pre-forms achieve substantial contact therebetween and remain in substantial contact due to peripheral confining pressure upon the assembly of pre-forms, without any sintering occurring between individual pre-forms, resulting from the relative greater shrinkage of the high temperature material;

filling the fired, circumferentially clamped assembly of pre-forms with a molten material;

cooling the molten material within the fired circumferentially clamped assembly of pre-forms; and removing the one or more bands of flexible high temperature material, thereby allowing the pre-forms to separate from each other by removing the peripheral confining pressure thereon.

30. The method of casting of claim 29, wherein the flexible high temperature material comprises a woven tape of refractory material.

31. The method of casting of claim 29, wherein the method further comprises:

removing an article from the separated pre-forms;

placing the removed article within a mold;

filling the mold with a molten material, whereby the article functions as a core;

cooling the molten material; and removing the core and the mold from the cooled molten material.

32. The method of casting of claim 29, wherein the refractory article comprises a mold for use in metal castings.

33. The method of casting of claim 29, wherein the refractory material comprises a refractory powder in a thermosetting silicone or phenolic resin binder.

34. The method of casting of claim 33, wherein the formation of the article in the die includes the further steps of heating the mixture to a temperature at which it softens, but below the setting temperature of the resin binder, and injecting the hot material into said at least one dye under pressure.

35. The method of casting of claim 29, wherein the flexible high temperature material is tensioned during the circumferentially clamping step and the tension in the high temperature material is prevented from relaxing by using a mechanical lock means.

36. A cast article made by the method of claim 29.

37. A cast article made by the method of claim 30.

* * * * *